US008910399B2

(12) United States Patent
Ickrath et al.

(10) Patent No.: US 8,910,399 B2
(45) Date of Patent: Dec. 16, 2014

(54) NESTING MODULAR ELEVATORS FOR FOOTWEAR

(76) Inventors: Hugh N. Ickrath, Manassas, VA (US); Kerry D. Ickrath, Manassas, VA (US)

( * ) Notice: Subject to any disclaimer, the term of this patent is extended or adjusted under 35 U.S.C. 154(b) by 187 days.

(21) Appl. No.: 13/477,980

(22) Filed: May 22, 2012

(65) Prior Publication Data

US 2013/0192089 A1 Aug. 1, 2013

Related U.S. Application Data

(60) Provisional application No. 61/591,103, filed on Jan. 26, 2012.

(51) Int. Cl.

| | |
|---|---|
| ***A43B 7/16*** | (2006.01) |
| ***A43B 7/38*** | (2006.01) |
| *B65D 21/08* | (2006.01) |

(52) U.S. Cl.

CPC ..... *A43B 7/38* (2013.01); *B65D 21/086* (2013.01)

USPC ..... 36/81; 200/8; 206/503; 206/505

(58) Field of Classification Search

CPC ..... A43B 7/38; A43B 1/14; A43B 3/0026; A43B 3/0047; A43B 3/128; A43B 3/16; A43B 3/24; A43B 3/246

USPC ..... 36/81, 103, 7.1 R, 15, 31; 446/26, 117, 446/120, 122, 124; 482/75; 405/41, 129.55; 220/4.26, 781, 8; 206/505, 515, 519, 206/518, 503

See application file for complete search history.

(56) References Cited

U.S. PATENT DOCUMENTS

| | | | | |
|---|---|---|---|---|
| 2,278,894 | A * | 4/1942 | Paulson | 446/117 |
| 2,747,300 | A | 5/1956 | Field | |
| 3,061,951 | A | 11/1962 | Barron | |
| 3,334,942 | A * | 8/1967 | Breslow | 297/1 |
| D217,371 | S * | 4/1970 | Clark | D21/422 |
| 3,751,833 | A * | 8/1973 | Humphrey | 36/81 |
| 3,829,990 | A | 8/1974 | Sakamoto | |
| 4,176,459 | A | 12/1979 | Perser et al. | |
| 4,699,601 | A * | 10/1987 | Hershfeld | 446/69 |
| 5,177,883 | A | 1/1993 | Darby | |
| 5,460,561 | A * | 10/1995 | Dahlgren | 446/117 |
| 6,588,616 | B1 * | 7/2003 | Ho | 220/4.03 |
| 7,674,207 | B1 | 3/2010 | Weaver et al. | |
| 2003/0200675 | A1 | 10/2003 | Gross | |
| 2008/0172132 | A1 * | 7/2008 | McKee | 623/28 |

FOREIGN PATENT DOCUMENTS

| | | | |
|---|---|---|---|
| GB | 851447 | * 10/1960 | 36/81 |

* cited by examiner

*Primary Examiner* — Khoa Huynh
*Assistant Examiner* — Katharine Gracz
(74) *Attorney, Agent, or Firm* — Richard C Litman

(57) ABSTRACT

The nesting modular elevators for footwear are a plurality of tapered, progressively wider units that assemble sequentially to one another and attach to the shoe of the wearer. Each unit has a generally oval planform and a hollow interior, permitting each successively smaller unit to be stored compactly within the next larger unit for storage. The base unit has a wide footprint that provides good stability for the assembly when in use. The larger or lowermost unit(s) may be omitted from the assembly when less than maximum height is required. In one embodiment, the units have mating laterally opposed channels and tracks respectively along the upper and lower edges thereof. In another embodiment, the units have mating opposed fore and aft tabs and slots respectively in the upper and lower edges thereof. These systems provide positive engagement of the units with one another, and preclude slippage between units.

10 Claims, 7 Drawing Sheets

NESTING MODULAR ELEVATORS FOR FOOTWEAR

CROSS-REFERENCE TO RELATED APPLICATION

This application claims the benefit of U.S. Provisional Patent Application Ser. No. 61/591,103, filed Jan. 26, 2012.

BACKGROUND OF THE INVENTION

1. Field of the Invention

The present invention relates generally to attachments for footwear, and particularly to nesting modular elevators for footwear to increase the height of the wearer of the attachments.

2. Description of the Related Art

The popularity of various entertainment events such as parades, live shows and concerts, certain athletic events, air shows, etc., generally results in very large crowds in attendance. While many of these events provide tiered seating for attendees, in many instances the venue does not lend itself to seating, and no elevated viewing area is provided. Attendees are reduced to peering around the heads and shoulders of other people in front of them in an attempt to see the performance for which they paid. While many taller people may not find this to be a significant problem, it most certainly is a significant problem for those of shorter stature who are located farther back in the audience. Children who have not yet reached their full adult height also experience this frustration.

There are many instances in the workplace where some additional height is needed for some purpose. An example of such is the case of the drywall mechanic, who installs wallboard in the interior of a structure. As ceilings are generally eight feet above the floor, some additional height is required for the worker to conveniently reach the ceiling for such panel work. While ladders have been used conventionally, they are not particularly convenient due to their bulk and weight, and of course they are completely unsuited for transport to an event, such as a concert or the like. Generally, those in charge of such an event would not allow a ladder or the like to be carried in to the event, even if it were placed at the rear of the crowd so as not to obstruct the view of others. While various tools, such as drywall stilts, have been developed for workers, such devices are not intended for long-term use and do not provide the stability and comfort that a concertgoer would require for standing for a prolonged period of time.

Thus, nesting modular elevators for footwear solving the aforementioned problems are desired.

SUMMARY OF THE INVENTION

The nesting modular elevators for footwear comprise a plurality of tapered, progressively wider units that assemble sequentially to one another and to a shoe or footwear attachment plate that is secured to the shoe of the wearer. Each unit has a generally oval planform and a hollow interior, permitting each successively smaller unit to be nested or stored compactly within the next larger unit when not in use.

In one embodiment, each unit has a pair of opposed parallel channels along the upper edges thereof. The lower edges of each unit have a pair of opposed parallel tracks that engage the channels of the next larger unit below when assembled. This system provides positive engagement of the units with one another, and precludes slippage between units. The base unit has a relatively wide footprint that provides good stability for the assembly when in use. However, the larger or lowermost unit(s) may be omitted from the assembly when less than maximum height is required. The units are preferably formed of plastic for light weight, good durability, and corrosion resistance, as well as for ease of manufacture.

In a second embodiment, the plurality of units are configured similar to those of the first embodiment, but secure to one another by forward and rearward tabs extending from the lower edges of most units. The tabs of each unit removably engage cooperating slots in the upper edge of the adjacent unit. The units of this embodiment may include additional features, e.g., peripheral rims around the upper edges for more positive assembly, stiffening ribs, etc. Rather than providing a separate shoe attachment unit, as in the first embodiment, the smallest uppermost unit is provided with lateral slots in the upper surface thereof, and lateral straps pass through the slots to wrap over the shoe. Such lateral strap attachment slots may be provided in other units as well.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The nesting modular elevators for footwear comprise one or more elevator units that attach to the sole of the shoe by suitable straps or the like. The elevator units are tapered so that the progressively smaller units may be nested within the progressively larger units for storage.

Figure 1:
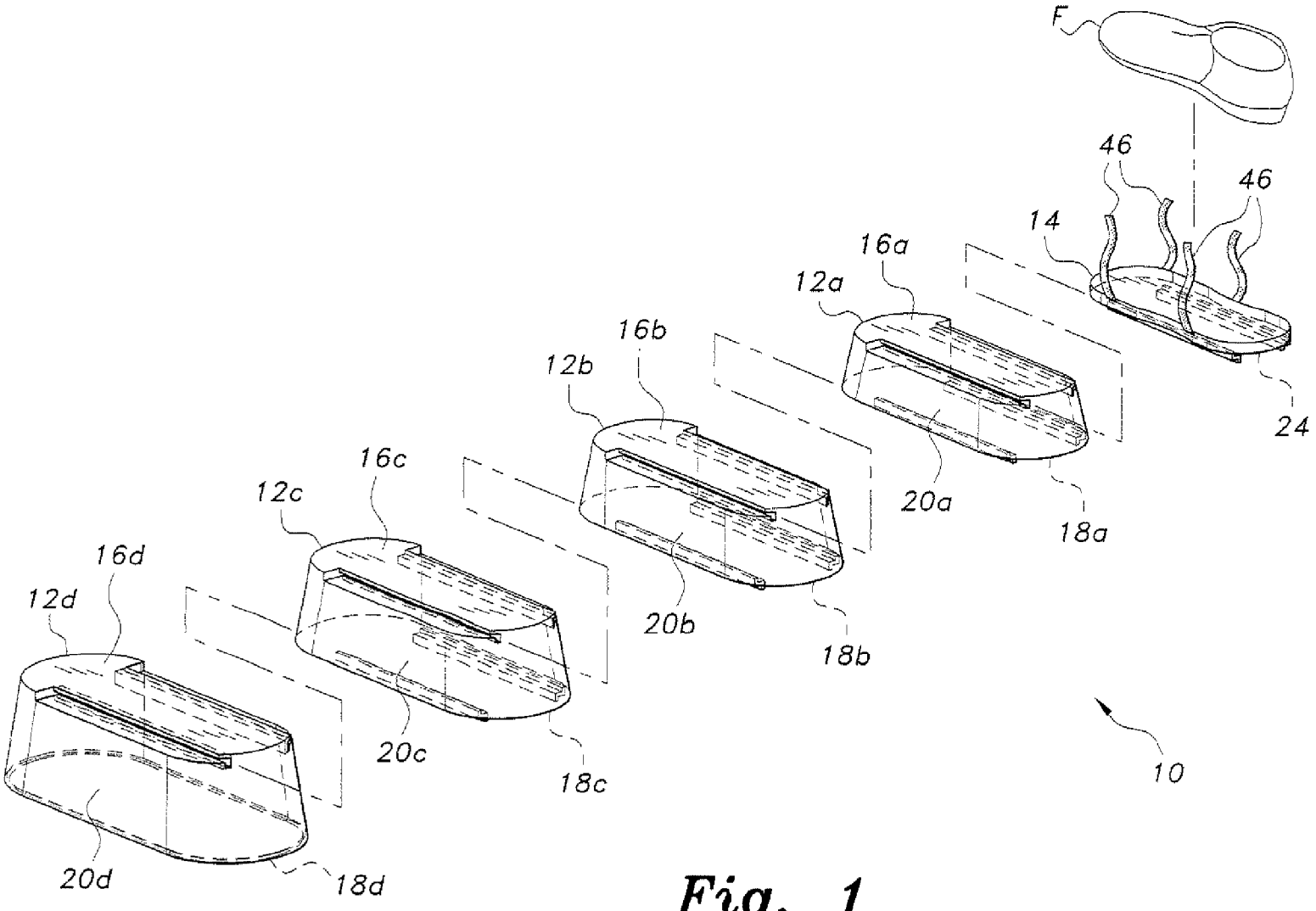
FIG. 1 is an exploded environmental perspective view of a first embodiment of nesting modular elevators for footwear according to the present invention, illustrating their assembly to one another and to an article of footwear.
Figure 2:
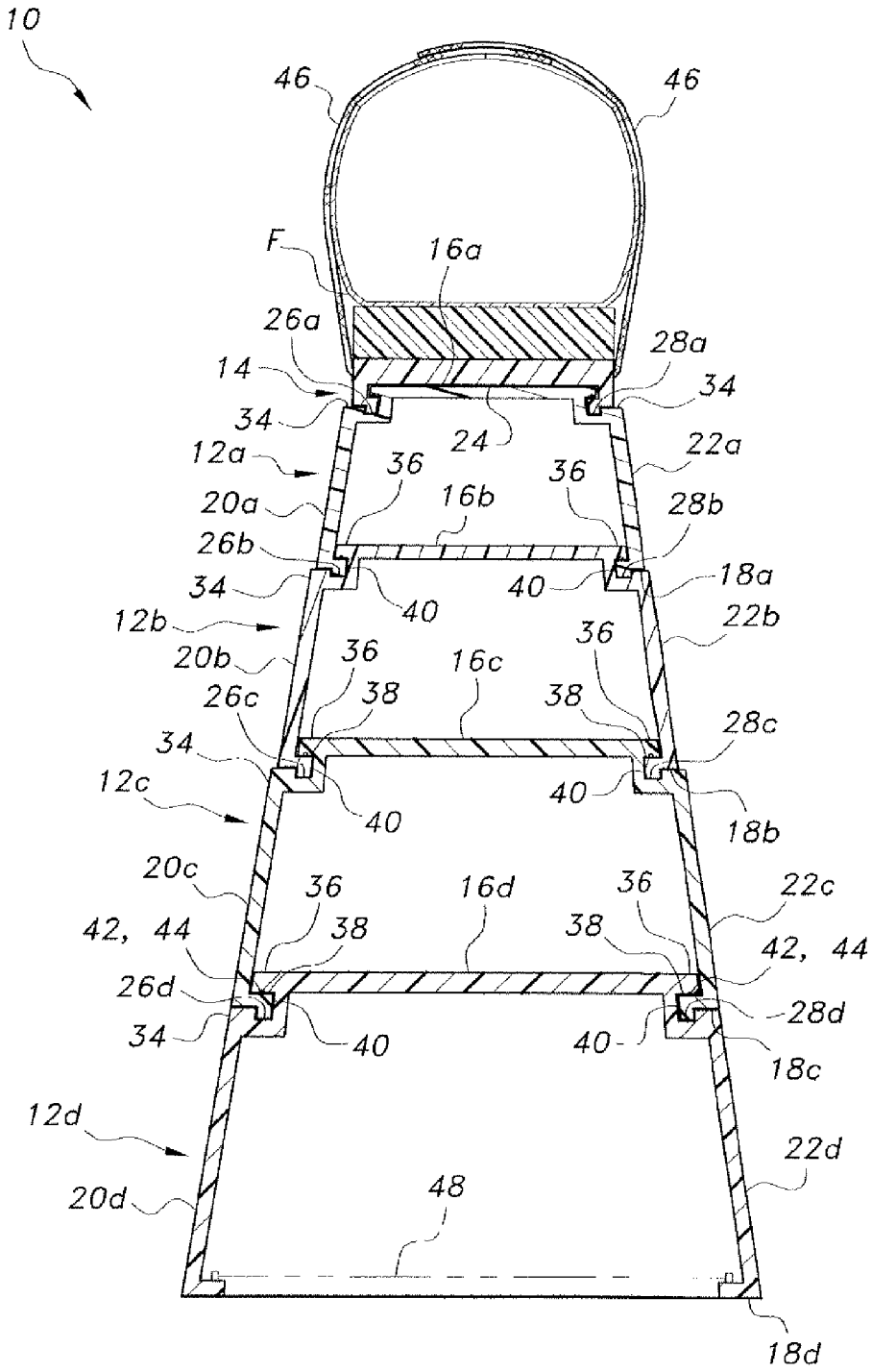
FIG. 2 is a rear elevation view in section of the nesting modular elevators for footwear of FIG. 1, showing their assembly to one another for use.
Figure 3:
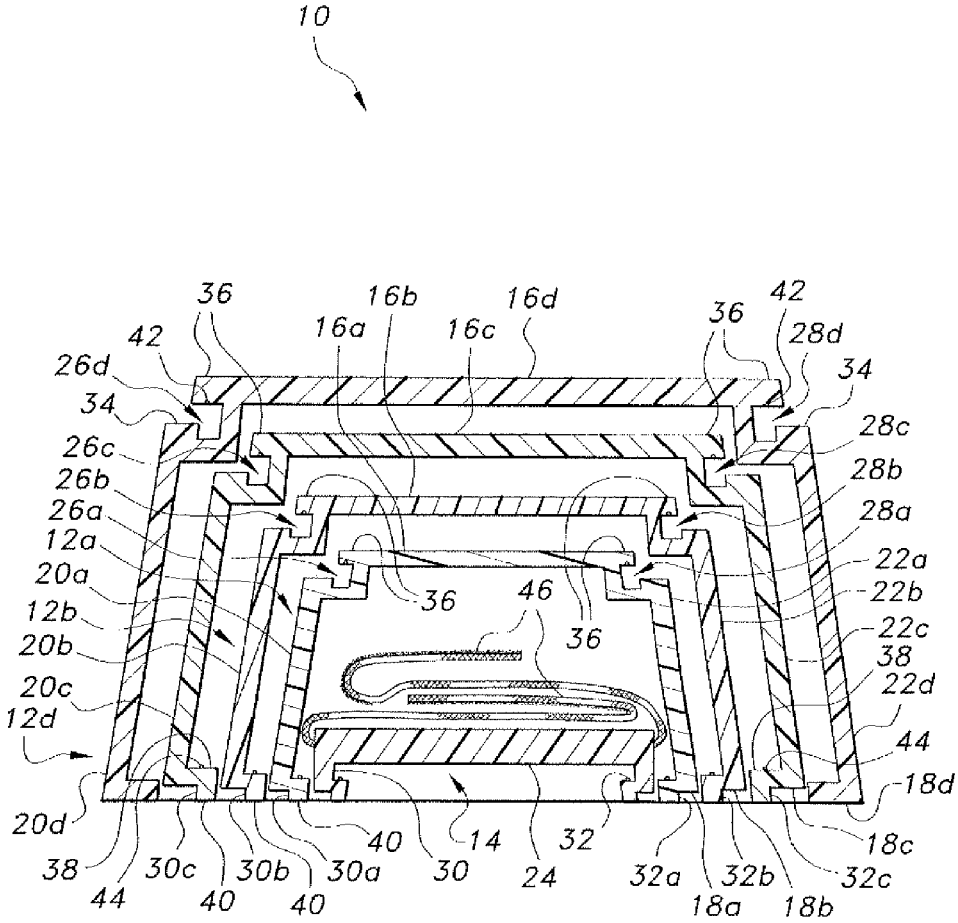
FIG. 3 is a rear elevation view in section of the nesting modular elevators for footwear of FIGS. 1 and 2, showing their nesting storage with one another.

FIGS. 1 through 3 provide illustrations of a first embodiment of the invention, designated as nesting modular elevator assembly 10. FIG. 1 provides an exploded perspective view, FIG. 2 shows a plurality of the elevator units assembled for use, and FIG. 3 illustrates the elevator units nested together for compact storage. The illustrated assembly includes first or upper, second, third, and fourth or lower elevator units 12*a*,

12*b*, 12*c*, and 12*d*, and the accompanying footwear attachment plate 14. More or fewer such elevator units may be provided in the assembly, if desired. Preferably, a set of at least three to four such elevator units is provided in order to allow the user to gain the maximum practical increase in height by using all of the available units, if necessary. However, the nesting modular elevators of the assembly 10 are configured so that fewer of the individual units may be used if less height increase is desired. The unused units may be stored until needed.

FIGS. 2 and 3 provide more detailed views of the assembly 10 in section to show various details thereof. Each of the elevator units 12*a* through 12*d* has a generally flat upper surface, as indicated at 16*a*, 16*b*, 16*c*, and 16*d*, and an opposite open lower surface, as indicated at 18*a*, 18*b*, 18*c*, and 18*d*, defining a hollow body. It will be noted that the lower surface of each unit is more precisely a lower rim surrounding the lower opening. This configuration permits the insertion of each increasingly smaller elevator unit into the hollow interior of the next larger unit, generally as illustrated in FIG. 3 of the drawings.

This arrangement is provided by the relatively smaller upper surface in comparison to the wider lower surface of each unit, due to the tapered first and second sides of each unit. Each unit includes first and second sides that taper downward and outward from top to bottom, i.e., first and second sides 20*a* and 22*a* for the smallest first or uppermost unit 12*a*, first and second sides 20*b* and 22*b* for the second unit 12*b*, etc., to the first and second sides 20*d* and 22*d* for the largest fourth or lowermost unit 12*d*. The semicircular ends of the generally oval planform units taper downward and outward in a similar manner. It will be seen that the upper surface of each successively larger elevator unit is substantially the same width as the lower surface of the elevator unit to which it attaches for assembly, i.e., the upper surface 16*d* of the base unit 12*d* is essentially the same width as the lower surface or bottom 18*c* of the next elevator unit 12*c*, etc. This arrangement continues upward to the footwear attachment plate 14, which has a bottom or first elevator attachment surface 24 that is essentially congruent with the underlying upper surface 16*a* of the first elevator unit 12*a* when the units are assembled as shown in FIG. 2 of the drawings. This arrangement provides good stability for the assembly due to the relatively wider base of the lowermost unit. The sides provide a smooth and constant slope from the base to the footwear attachment plate.

Each of the elevator units 12*a* through 12*d* includes a pair of opposed parallel channels along the opposite lower edges thereof. The channels engage mating tracks extending below the bottom or lower surface of the next smaller elevator unit, or from the footwear attachment plate 14 in the case of the first elevator unit 12*a*. The channels of the smallest uppermost or first elevator unit 12*a* are designated as channels 26*a* and 28*a*. The channels of the successively larger units 12*b*, 12*c*, and 12*d* are designated as channels 26*b* and 28*b*, 26*c* and 28*c*, and 26*d*, 28*d*, respectively.

The channels slide longitudinally onto corresponding tracks extending below the lower surfaces of the mating elevator units, or from the footwear attachment plate, as the case may be. The footwear attachment plate 14 includes two laterally opposed tracks 30 and 32, and the elevator units 12*a* through 12*c* having corresponding tracks 30*a*, 32*a*, 30*b*, 32*b*, 30*c*, and 32*c*, respectively. These tracks are shown in both FIGS. 2 and 3, the reference numerals indicating these tracks being shown in FIG. 3. The largest or lowermost elevator unit 12*d* does not require such tracks, as it does not attach to another unit. Thus, the two channels 26*a*, 28*a* of the first elevator unit 12*a* slide onto the mating tracks 30 and 32 of the footwear attachment unit 14, the two channels 26*b*, 28*b* of the next elevator unit 126 slide onto the mating tracks 30*a*, 32*a* of the first elevator unit 12*a*, etc., to assemble the units to one another and to the footwear attachment plate 14, as shown in FIG. 2.

Each channel is defined or limited by an outwardly disposed retainer 34 comprising a raised continuation of the corresponding side of the elevator unit, and an overlying flange 36 that comprises a lateral extension of the corresponding upper surface of the elevator unit. Each of the tracks 30 through 32*c* includes an inwardly oriented rail 38 having a downwardly oriented ridge 40 extending therefrom. (Only a few of the above components 34 through 40 are designated in FIGS. 2 and 3, for clarity in the drawings.) In this manner, the tracks are prevented from escaping upward from their mating channels due to the overlying flanges 36, and are further prevented from escaping outward (i.e., splaying flexibly) due to the outwardly disposed retainers 34 of each channel.

The above-described structure prevents each of the elevator units 12*a*-12*d* and the footwear attachment plate 14 from separating from one another either vertically or laterally when they are assembled together. Further security is provided by small receptacles or sockets 42 formed in the flanges of the channels and mating pins or nubs 44 extending from the rails of the tracks. Thus, when the various units are slid longitudinally together with their channels and tracks securing the units laterally and vertically, the units lock together longitudinally as the pins 44 engage the sockets 42. The receptacles 42 and mating pins 44 may be provided elsewhere than as shown in FIGS. 2 and 3, e.g., in mating sides of the channels and tracks, etc. The various elevator units 12*a* through 12*d* and the footwear attachment plate 14 are preferably formed of plastic, which provides sufficient flexibility to allow the pins 44 to slide in their mating tracks until engaging the corresponding receptacles, thereby securing the units to one another until some moderate intentional force is applied to release the pins from their sockets for disassembly. The use of plastic also provides a relatively lightweight assembly while still providing good durability, as well as obviating corrosion.

While only a single modular nesting elevator assembly 10 is illustrated in the drawings of FIGS. 1 through 3, it will be seen that the assembly is provided in pairs comprising a left assembly and a right assembly. The various corresponding units making up each assembly are identical, i.e., two of the first elevator units 12*a*, two of the footwear attachment plates 14, etc. would be provided in a complete set comprising two of the assemblies as shown in each of the drawings. The assembly comprising at least the first elevator unit 12*a* and footwear attachment plate 14 is secured to the footwear by means of lateral straps 46 extending from the sides of the plate 14, the straps wrapping up and over the footwear F (e.g., shoe, boot, etc.). The straps 46 are secured to one another by conventional means, e.g., mating hook and loop fabric material (Velcro®), or snaps or other conventional means. The result is a stable platform for the user of the paired assemblies, providing the user with a good view over and beyond taller persons and objects to the front. When use of the elevators is no longer needed, they may be nested together, as shown in FIG. 3, for compact storage. A securing strap 48 or the like, shown in broken lines as an optional component across the bottom 18*d* of the lowermost unit 12*d* in FIG. 2, may be provided to secure the remaining units within the interior of the largest unit 12*d*.

Figure 4:
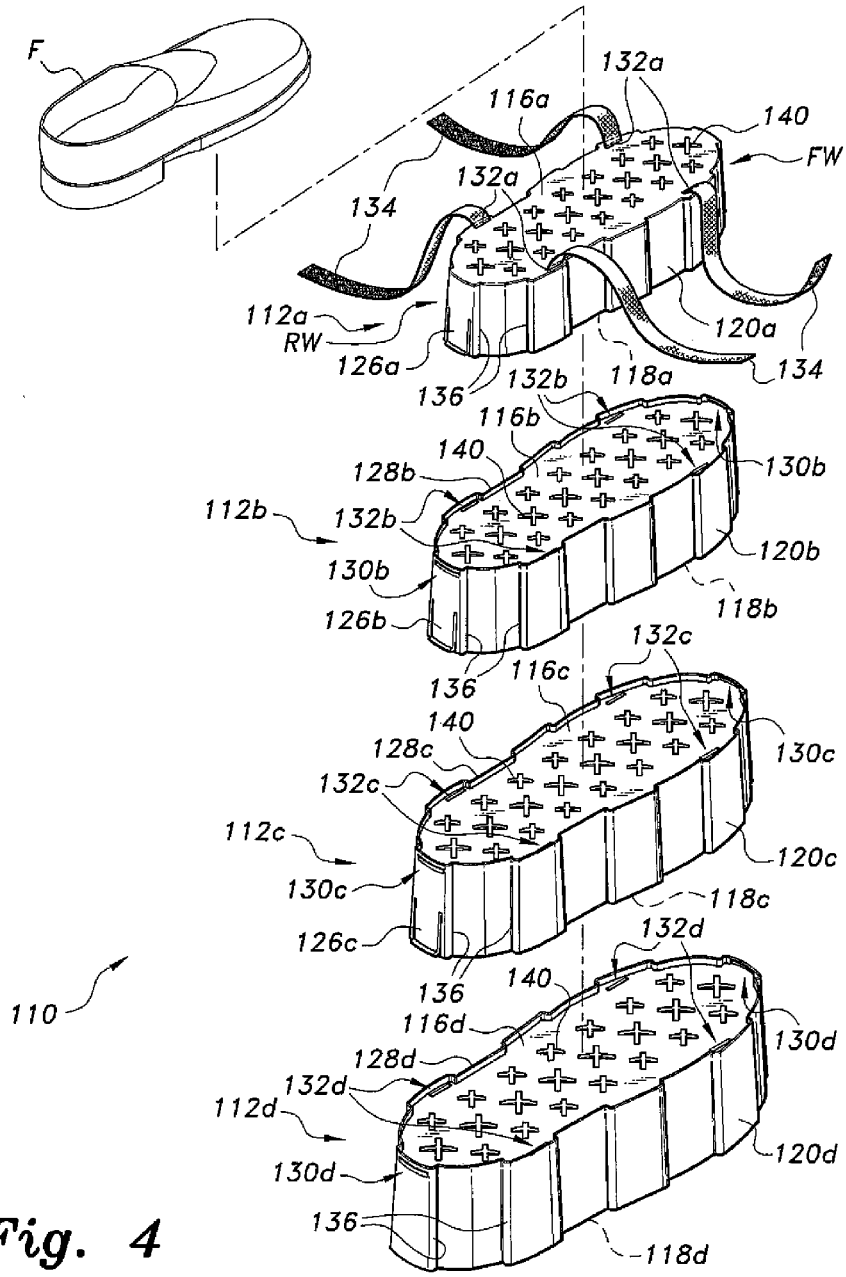
FIG. 4 is an exploded environmental perspective view of a second embodiment of nesting modular elevators for footwear according to the present invention, illustrating their assembly to one another and to an article of footwear.
Figure 5:
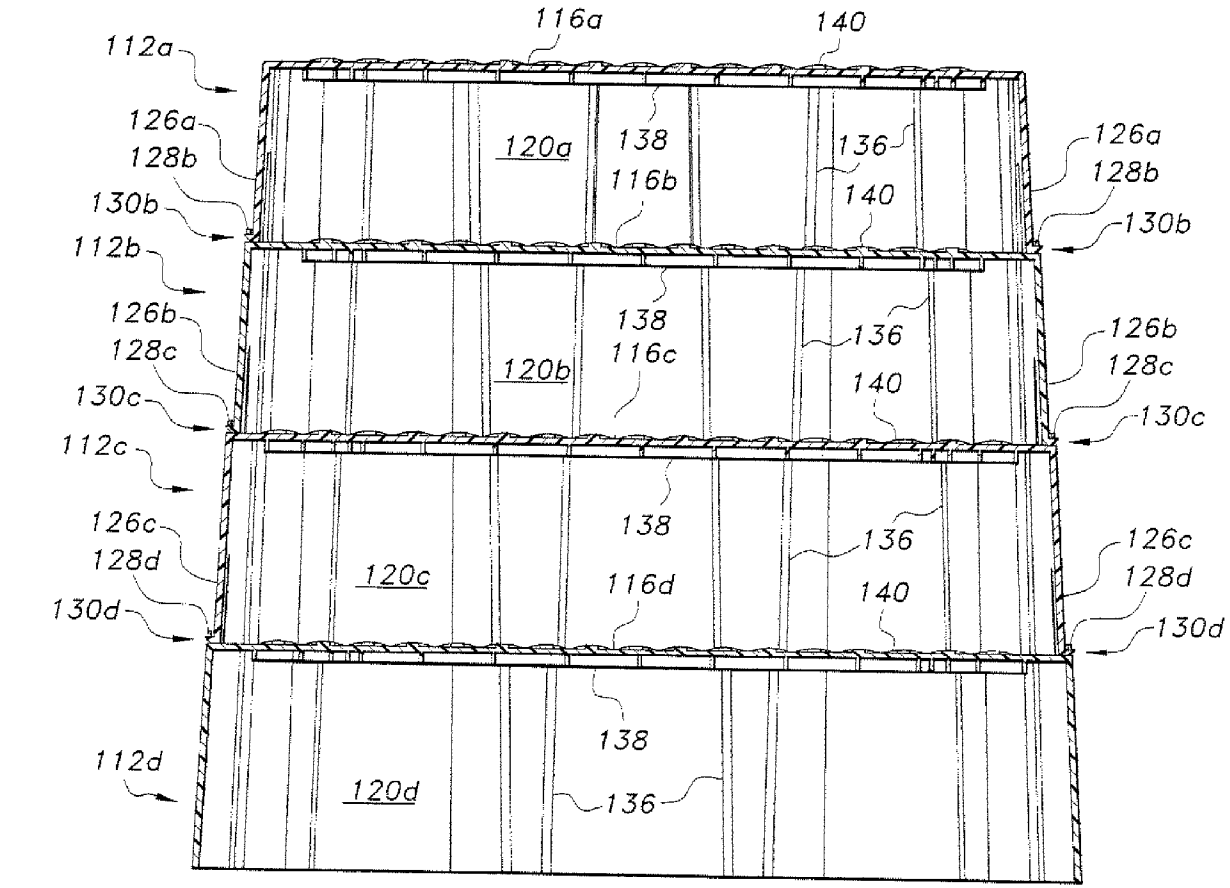
FIG. 5 is a rear elevation view in section of the nesting modular elevators for footwear of FIG. 4, showing their assembly to one another for use.
Figure 6:
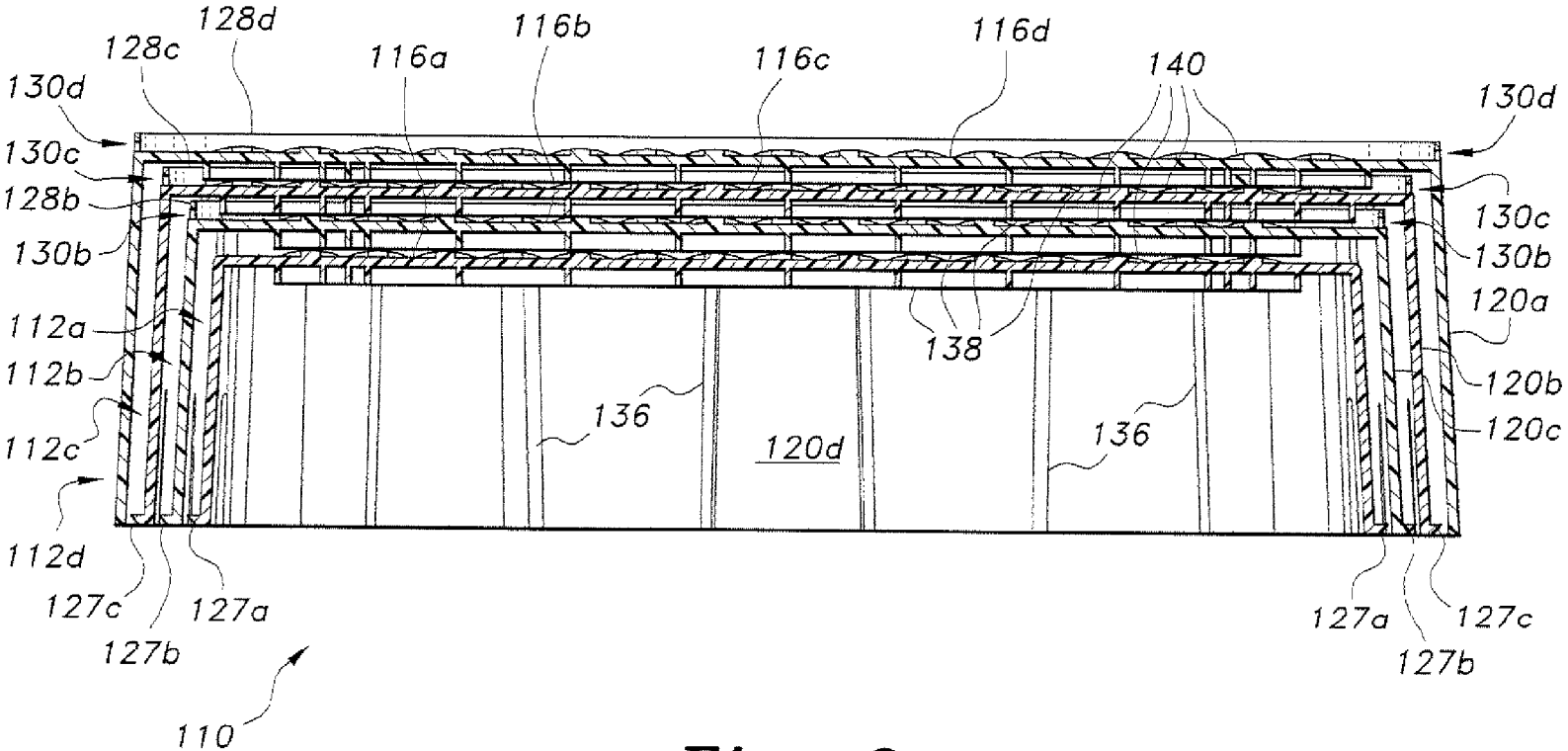
FIG. 6 is a rear elevation view in section of the nesting modular elevators for footwear of FIGS. 4 and 5, showing their nesting storage with one another.
Figure 7:
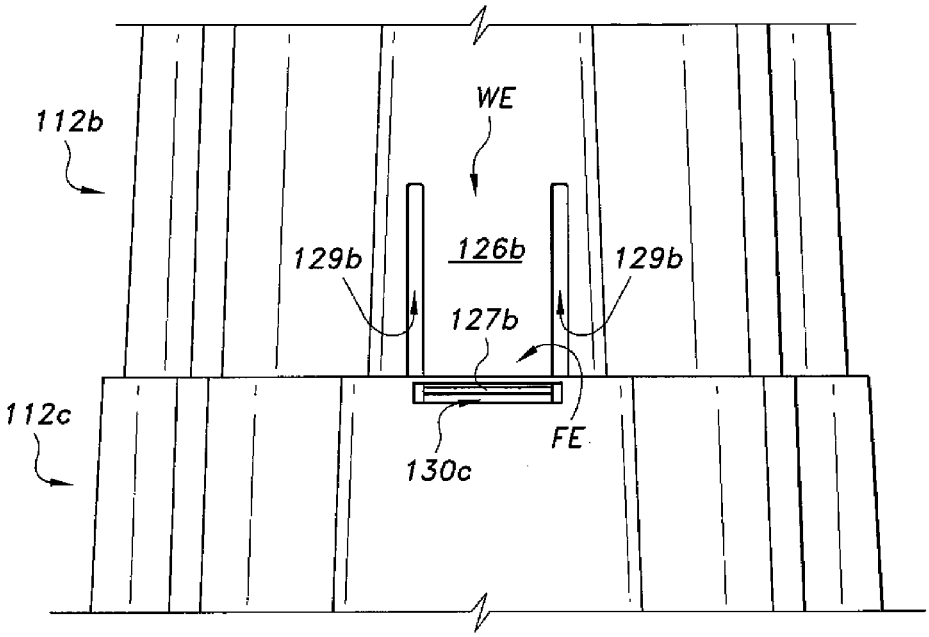
FIG. 7 is a partial end elevation view of two of the nesting modular elevators for footwear according to the embodiment of FIGS. 4 through 6 of the present invention, showing a detailed view of the means for the attachment of one unit to another.

FIGS. 4 through 7 provide views of a second embodiment of the nesting modular elevators for footwear, which is designated by the reference numeral 110 in FIGS. 4, 5, and 6. FIG. 4 provides an exploded perspective view, FIG. 5 shows a plurality of the elevator units assembled for use, FIG. 6 illustrates the elevator units nested together for compact storage, and FIG. 7 shows details of the specific means for attaching one unit to another. The illustrated assembly includes first or upper, second, third, and fourth or lower elevator units 112*a*, 112*h*, 112*c*, and 112*d*. The terms "upper" and "lower" used herein, refer to the respective units when assembled or stacked together. The arrangement is reversed when the smaller units are nested within the larger units for storage. More or fewer such elevator units may be provided in the assembly, if desired. Preferably, a set of at least three to four such elevator units is provided in order to allow the user to gain the maximum practical increase in height by using all of the available units, if necessary. However, the nesting modular elevators of the assembly 110 are configured so that fewer of the individual units may be used if less height increase is desired. The unused units may be stored until needed.

FIGS. 5 and 6 provide more detailed views of the assembly 110 in section to show various details thereof. Each of the elevator units 112*a* through 112*d* has a generally flat, horizontally elongated upper surface, as indicated at 116*a*, 116*b*, 116*c*, and 116*d*, and an opposite open lower surface, as indicated at 118*a*, 118*b*, 118*c*, and 118*d*, defining a hollow body. It will be noted that the lower surface of each unit is more precisely a lower rim surrounding the lower opening. This configuration permits the insertion of each increasingly smaller elevator unit into the hollow interior of the next larger unit, generally as illustrated in FIG. 6 of the drawings.

This arrangement is provided by the relatively smaller upper surface in comparison to the wider lower surface or rim of each unit, due to the tapered first and second sides or walls of each unit. Rather than defining opposite sides or walls for each unit, as in the embodiment of FIGS. 1 through 3, the side or wall of each unit is defined as being peripherally continuous about the entire unit. Each side or wall tapers downward and outward from top to bottom, i.e., side or wall 120*a* for the smallest first or uppermost unit 112*a*, side or wall 120*b* for the second unit 112*b*, etc., to the side or wall 120*d* for the largest fourth or lowermost unit 112*d*.

It will be seen that the upper surface of each successively larger elevator unit is substantially the same width as the lower surface of the elevator unit to which it attaches for assembly, i.e., the upper surface 116*d* of the base unit 112*d* is essentially the same width as the lower surface or bottom 118*c* of the next elevator unit 112*c*, etc. This arrangement provides good stability for the assembly due to the relatively wider base of the lowermost unit. The sides provide a smooth and constant slope from the base to the uppermost elevator unit being used.

The means provided for attaching each of the elevator units 112*a* through 112*d* to one another differs from that used for the elevator units 12*a* through 12*d* of the first embodiment of FIGS. 1 through 3. At least each of the upper elevator units 112*a* through 112*c* includes two mutually opposed latch tabs extending or protruding slightly from the opposite ends of the unit, i.e., the upper unit 112*a* has two opposed tabs 126*a*, unit 112*b* has tabs 126*b*, and unit 112*c* has tabs 126*c*. While the lowermost elevator unit 112*d* may also be provided with such tabs, it is not necessary as this lowermost unit does not engage another lower unit. Each of these latch tabs comprises a depending section of the corresponding wall that is separated from the wall along each of its opposite edges, but is flexibly joined to the wall along its upper end. The tabs are essentially coplanar with the corresponding portion of the wall, but each tab has an outwardly protruding tang 127*a*-127*e*, e.g., tang 127*b*, shown in FIG. 7.

At least each of the lowermost units includes a short rim extending upwardly from the respective upper surface, i.e., the lowermost unit 112*d* has a rim 128*d*, the next unit up 112*c* has a rim 128*c*, and the next higher unit 112*b* has a rim 128*b*. Each of these rims includes two mutually opposed slots at the opposite forward and rearward ends thereof, i.e., the second highest or second smallest unit 112*b* has horizontally elongated slots 130*b* at the ends thereof, the next unit 112*c* down has horizontally elongated slots 130*c*, and the lowermost unit 112*d* has horizontally elongated slots 130*d* in the opposite ends thereof. As seen in FIG. 4, the forward and rearward ends are shown as the forward portion FW and rearward portion RW. The various horizontally elongated slots provide for the releasable engagement of the tangs of the corresponding tabs of the next higher unit. Each of the tabs 126*a* through 126*d* is separated laterally from its respective elevator unit 112*a* through 112*d* by left and right slits, e.g., slits 129*b* of the elevator unit 112*b* shown in FIG. 7. The closed ends of the slits terminate at the wall end WE and the free ends of the slits, including the tabs, are located at the free end FE. These slits allow their respective tabs to be flexed inwardly to allow their tangs to clear the structure surrounding the horizontally elongated slot of the underlying elevator unit. The resilience of the tabs causes the respective tangs to snap into place in the corresponding horizontally elongated slot of the underlying unit. Thus, the uppermost elevator unit 112*a* may be releasably secured to the next lower unit 112*b* by engaging the outwardly protruding tangs of the forward and rearward tabs 126*a* into the horizontally elongated slots 130*b* in the rim 128*b* of the next lower unit 112*b*. The tangs 127*b* of the tabs 126*b* of the unit 112*b* engage the horizontally elongated slots 130*c* in the rim 128*c* of the unit 112*c* immediately below, as shown in FIG. 7. It will be seen that the tab, tang, and slot attachment is the same for the adjacent units, with FIG. 7 illustrating an exemplary attachment between the two units 112*b* and 112*c*. The tangs of the tabs 126*c* of the unit 112*c* engage the horizontally elongated slots 130*d* in the rim 128*d* of the lowermost unit 112*d* to provide an assembly as shown in section in FIG. 2 of the drawings. As the highest elevator unit 112*a* does not engage another unit thereabove, it need not be equipped with a rim having slots therein, although such a rim may be included with the uppermost unit 112*a*, if desired.

Rather than providing a separate footwear attachment plate, as in the first embodiment of FIGS. 1 through 3, the uppermost elevator unit 112*a* includes a plurality of attachment strap passages or slots 132*a* through the upper surface 116*a* thereof. These slots 132*a* or passages are preferably formed through the periphery of the upper surface 116*a* adjacent its juncture with the upper edge of the surrounding wall 120*a*, and include forward and rearward pairs of laterally opposed attachment strap passages 132*a*. Corresponding forward and rearward footwear attachment straps 134 are passed through the respective forward and rearward pairs of attachment strap passages 132*a* to extend beneath the upper surface 116*a* of the elevator unit 112*a*. Normally only the uppermost elevator unit 112*a* would be attached directly to the user's footwear, but under some circumstances the user may wish to attach a lower and larger unit directly to his or her footwear. Accordingly, the other elevator units 112*b*, 112*c*, and 112*d* may be provided with footwear attachment strap passages or slots, respectively 123*b*, 132*c*, and 132*d*, as shown in FIG. 4 of the drawings.

The various elevator units 112*a* through 112*d* are preferably formed of a lightweight plastic material for durability and corrosion resistance, as well as to provide the required flexibility for the latch tabs 126*a* through 126*c*. As such material is somewhat flexible, additional stiffening or reinforcement of each of the elevator units 112*a* through 112*d* may be provided. Each of the sidewalls 120*a* through 120*d* includes a plurality of substantially vertical reinforcement members 136 therein, with the reinforcement members defining an alternating series of protruding and inset faces along each of the walls. In addition, the underside or inner side of the plate forming the upper surface 116*a* through 116*d* of each of the elevator units may include a series of stiffening flanges or reinforcing ribs 138 formed integrally therewith, to stiffen the upper surface of each of the units. This is particularly critical for the upper elevator unit 112*a* that will have the weight of the user imposed directly thereon, but such stiffening flanges or ribs 138 may be provided for the other elevator units 112*b*, 112*c*, and 112*d* as well. Similarly, the upper unit 112*a* is preferably provided with a high friction textured surface 140 over the upper surface 116*a* thereof in the form of a series of raised cruciform protrusions or other configuration. As in the case of the stiffening flanges 138, this surface texturing 140 need be applied only to the uppermost elevator unit 112*a* if that uppermost unit is the only unit adapted for direct attachment to footwear. However, such surface texture 140 may be applied to the other elevator units 112*b* through 112*d*, as shown in FIGS. 4 through 6.

As in the ease of the first embodiment 10 of FIGS. 1 through 3, it will be seen that the nesting modular elevator assembly 110 is provided in pairs comprising a left assembly and a right assembly. The various corresponding units making up each assembly are identical, i.e., two of the first elevator units 112*a*, two of the second elevator units 112*b*, etc. would be provided in a complete set comprising two of the assemblies as shown in FIGS. 4 through 6. The assembly comprising at least the first elevator unit 112*a* and footwear attachment straps 134 is secured to the footwear F by wrapping the straps up and over the footwear F (e.g., shoe, boot, etc.). The straps 134 are secured to one another by conventional means, e.g., mating hook and loop fabric material (Velcro®), or snaps or other conventional means. The result is a stable platform for the user of the paired assemblies, providing the user with a good view over and beyond taller persons and objects to the front. When use of the elevators 110 is no longer needed, they may be nested together, as shown in FIG. 6, for compact storage. A securing strap or the like, e.g., the strap 48 shown in broken lines as an optional component across the bottom 18*d* of the lowermost unit 12*d* in FIG. 2 for the first embodiment 10, may be provided to secure the remaining units within the interior of the largest unit 12*d*.

It is to be understood that the present invention is not limited to the embodiments described above, but encompasses any and all embodiments within the scope of the following claims.

We claim:

1. Nesting modular elevators for footwear, comprising:

a plurality of elevator units including a lower elevator unit and an upper elevator unit, each of the elevator units having a horizontally elongated closed upper surface (116) parallel to one another, an open lower surface (118) having a width greater than the upper surface, and a peripherally continuous wall (120) extending between the upper surface and the lower surface thereof, wherein said peripherally continuous wall is tapered from the lower surface to the upper surface;

said upper elevator unit having at least one tab defined by a pair of opposed slits formed through the wall, the tab being coplanar with the peripherally continuous wall thereof, wherein the tab has a wall end (WE) and a free end (FE), the free end of the tab being resiliently flexible relative to the wall end of the tab;

the at least one tab having an integral tang protruding outwardly from the free end of the tab; and said lower elevator unit having a rim extending upwardly from the upper surface, the rim having at least one forward horizontally elongated slot and a rearward slot disposed therethrough, the at least one integral tang removably and resiliently engaging the corresponding horizontally elongated slot of another unit for removably securing the elevator units to one another, whereby the resilience of the tabs of the upper elevator unit allows the integral tang to deform inwardly and snap into place in the horizontally elongated slot of the lower elevator unit, wherein the tab, the integral tang and the horizontally elongated slot are designed to allow the elevator unit to be stacked over one another.

2. The nesting modular elevators for footwear according to claim 1, further comprising:

at least the upper unit having laterally opposed forward strap passages and laterally opposed rearward strap passages disposed through the upper surface thereof; and forward and rearward footwear attachment straps removably disposed through the respective strap passages.

3. The nesting modular elevators for footwear according to claim 1, further comprising a plurality of substantially vertical reinforcement members disposed in the wall of each unit.

4. The nesting modular elevators for footwear according to claim 1, further comprising a high friction textured surface disposed atop the upper surface of at least the upper unit.

5. The nesting modular elevators for footwear according to claim 1, further comprising a plurality of stiffening flanges disposed beneath the upper surface of each elevator unit to support the weight of the user.

6. The nesting modular elevators for footwear according to claim 1, wherein the at least one tab extends from a forward portion (FW) of said peripherally continuous wall thereof.

7. The nesting modular elevators for footwear according to claim 1, wherein the at least one tab extends from a rearward portion (RW) of said peripherally continuous wall thereof.

8. The nesting modular elevators for footwear according to claim 1, wherein said upper unit has a forward tab and a rearward tab extending from the peripherally continuous wall, wherein each of the forward and rearward tabs have the integral tang protruding outwardly therefrom.

9. The nesting modular elevators for footwear according to claim 1, wherein each elevator unit is formed of plastic.

10. The nesting modular elevators for footwear according to claim 1, further comprising at least one intermediate elevator unit located between the lower elevator unit to the upper elevator unit, wherein the at least one intermediate elevator unit includes:

a horizontally elongated closed upper surface parallel to the closed upper surfaces of the upper and lower elevator units, an open lower surface having a width greater than the upper surface, and a peripherally continuous wall extending between the upper surface and the lower surface thereof, wherein said peripherally continuous wall is tapered from the lower surface to the upper surface;

said intermediate elevator unit having at least one tab defined by a pair of opposed slits formed through the peripherally continuous wall, the tab being coplanar with the peripherally continuous wall thereof, wherein the tab has a wall end and a free end, the free end of the tab being resiliently flexible relative to the wall end of the tab;

the tab having an integral tang protruding outwardly from the free end of the tab; and said lower elevator unit having a rim extending upwardly from the upper surface, the rim having at least one forward horizontally elongated slot and a rearward slot disposed therethrough, the at least one integral tang removably and resiliently engaging the corresponding horizontally elongated slot of another unit for removably securing the elevator units to one another, whereby the resilience of the tabs of the intermediate elevator unit allows the integral tang to deform inwardly and snap into place in the horizontally elongated slot of the lower elevator unit, wherein the tab, the integral tang and the horizontally elongated slot are designed to allow the elevator unit to be stacked over one another.

* * * * *